United States Patent [19]

Paspek, Jr.

[11] Patent Number: 4,483,761

[45] Date of Patent: Nov. 20, 1984

[54] UPGRADING HEAVY HYDROCARBONS WITH SUPERCRITICAL WATER AND LIGHT OLEFINS

[75] Inventor: Stephen C. Paspek, Jr., North Royalton, Ohio

[73] Assignee: The Standard Oil Company, Cleveland, Ohio

[21] Appl. No.: 510,524

[22] Filed: Jul. 5, 1983

[51] Int. Cl.[3] ..... C106 9/00

[52] U.S. Cl. ..... 208/106; 208/107; 208/125; 208/130

[58] Field of Search ..... 208/106, 130, 107, 125, 208/128

[56] References Cited

U.S. PATENT DOCUMENTS

| | | | |
|---|---|---|---|
| 1,613,010 | 7/1923 | Armstrong . | |
| 2,608,524 | 5/1948 | Johnson et al. . | |
| 2,626,233 | 1/1953 | Kimberlin et al. . | |
| 3,542,668 | 11/1970 | Van Pool . | |
| 3,579,438 | 5/1971 | Cruse . | |
| 3,617,497 | 11/1971 | Bryson et al. . | |
| 3,758,400 | 9/1973 | Hampton . | |
| 3,948,754 | 4/1976 | McCollum et al. . | |
| 3,948,755 | 4/1976 | McCollum et al. . | |
| 3,954,600 | 5/1976 | Gladrow et al. . | |
| 3,960,708 | 6/1976 | McCollum et al. . | |
| 3,989,618 | 11/1976 | McCollum et al. | 208/106 |
| 4,002,557 | 1/1977 | Owen et al. . | |
| 4,005,005 | 1/1977 | McCollum et al. . | |
| 4,146,465 | 3/1979 | Blazek, Sr. et al. . | |
| 4,151,068 | 4/1979 | McCollum et al. . | |
| 4,290,880 | 7/1981 | Leonard . | |

*Primary Examiner*—Delbert E. Gantz
*Assistant Examiner*—Anthony McFarlane
*Attorney, Agent, or Firm*—Salvatore P. Pace; David J. Untener; Larry W. Evans

[57] ABSTRACT

Heavy hydrocarbons are upgraded and cracked in a process comprising contacting the heavy hydrocarbons with olefins containing 5 or less carbon atoms and a solvent, at a temperature both sufficient for cracking and greater than or equal to the critical temperature of the solvent.

19 Claims, No Drawings

UPGRADING HEAVY HYDROCARBONS WITH SUPERCRITICAL WATER AND LIGHT OLEFINS

BACKGROUND OF THE INVENTION

1. Field of the Invention

This invention relates to the upgrading and cracking of heavy hydrocarbons to lighter, fuel range liquids. More specifically this invention relates to the use of a water containing medium as a means for cracking heavy hydrocarbons in the presence of light olefins in order to improve the yields of liquid products and decrease the yield of gaseous products.

2. Description of the Prior Art

Cracking is a refining process involving the decomposition and molecular recombination of organic compounds, especially hydrocarbons obtained by the distillation of petroleum, by means of heat, to form molecules suitable for motor fuels, monomers and petrochemicals. In the cracking process, a series of molecular reactions take place accompanied by the transfer of hydrogen atoms between molecules which brings about fundamental changes in their structure.

There are two major types of cracking operations. Thermal cracking exposes petroleum distillate to temperatures of about 540° C. to 650° C. for varying periods of time. Catalytic cracking employs a metallic catalyst over which hydrocarbon vapors are passed to about 400° C.

In both thermal and catalytic cracking processes steam has been used as a diluent for the organic matter. Typically, the cracking processes employing steam operate at between 50 and 150 psig.

In part, the instant invention pertains to dense, water containing fluids at elevated temperatures and pressures, used as a cracking medium. More specifically, the instant invention pertains to the use of supercritical fluids as a cracking medium. A fluid which is at both a temperature and pressure exceeding its critical temperature and pressure is a supercritical fluid. A supercritical fluid exists as a form of matter in which its liquid and gaseous states are indistinguishable from one another. The critical temperature of a fluid is the temperature above which that fluid cannot be liquified by an increase in pressure. The critical pressure of a fluid is simply the pressure of the fluid at its critical temperature.

Of particular interest in the instant invention are dense water containing fluids at supercritical conditions used as a cracking medium. Water is a supercritical fluid when its temperature and pressure exceed 374° C. and 3204 psi (218.3 atm). The conditions and properties of this water containing fluid places it outside the scope of steam.

Lastly, the instant invention pertains to the use of light olefins in the supercritical fluid cracking process. Light olefins have been added to thermal and catalytic cracking processes in order to serve as a diluent or to drive the reaction equilibrium away from the formation of gaseous olefins. The instant invention seeks to achieve a significant increase in the amount of liquid range products from the supercritical fluid cracking of heavy hydrocarbons by the addition of light olefins.

SUMMARY OF THE INVENTION

A process for improving the liquid yield from the cracking of heavy hydrocarbons has been discovered. This process comprises the contacting of heavy hydrocarbons with light olefins and a solvent at a temperature sufficient for cracking the heavy hydrocarbons and greater than or equal to the critical temperature of the solvent.

DETAILED DESCRIPTION OF THE INVENTION

Any cracking operation of heavy hydrocarbons will yield both liquid and gaseous products. However in cracking processes employing supercritical fluids as a cracking medium, it has been discovered that the overall gas make is reduced and the liquid yield is improved by the addition of light olefins to the feedstock. In these cracking processes it is believed that the addition of light olefins serve at least three functions. The light olefins initiate and promote the cracking of heavy hydrocarbons; the light olefins react and combine with thermally cracked fragments; and the light olefins oligomerize to form liquid range products.

Heavy hydrocarbons suitable for this invention are those with an I.B.P. of 200° C. and greater. This invention is especially well suited for those heavy hydrocarbons prevalent in the synthetic fuels industry such as tar, bitumen, shale oil, other heavy oils, kerogen and coal liquids.

Suitable light olefins contain 5 or less carbon atoms. Representative of the olefins of use in this invention are ethylene, propylene, butylene, butadiene and pentene as well as isomers and substituted derivatives of these compounds. Typically these olefins are gaseous by-products resulting from cracking operations. However, olefins containing 5 or less carbon atoms and derived from any source may be utilized in this invention.

The olefins employed in the instant invention do not require a high degree of purity. The olefins may constitute a fraction of a feedstock containing a wide range of organic and inorganic matter. It is possible to use ordinary refinery streams, such as coker-off-gas or retort off-gas, without special preparation. The instant invention may even be employed for feedstreams containing olefins in quantities so small as to not be economically feasible to recover by known methods.

Heavy hydrocarbons are cracked in the presence of light olefins while in contact with a solvent. The list of solvents suitable for cracking is quite extensive and includes both organic and inorganic compounds. Representative of specific solvents of use as a cracking medium include carbon dioxide, ammonia, water, methanol, higher alcohols, benzene, toluene, dichlorodifluoromethane, nitrous oxide, diethyl ether, sulfur dioxide, carbon disulfide, tetrahydrofuran, acetone, pyridine and methyl chloride and the like, as well as mixtures of the above. The preferred solvents or mixtures of solvents have the ability to donate a hydrogen for saturating double bonds. Solvents or mixtures thereof not capable of donating a hydrogen atom are still viable, but are best employed where hydrogen gas is introduced from an external source. More preferred solvents are water, alcohols and mixtures thereof.

The cracking of the heavy hydrocarbons occurs in a mixture of heavy hydrocarbons, olefins and solvent which is substantially a one phase medium. This medium is not gaseous or liquid in the common meaning of these terms, for the density of the medium is greater than the density of the gaseous phase of the solvent but less than the density of the liquid phase. In order to obtain this intermediate state, the medium must be at elevated temperatures and pressures which are equal to or greater than the critical temperature and pressure of the solvent employed in the cracking medium. Critical temperature and pressure data for the solvents of use in this invention can be found in a large number of texts and references, e.g. *CRC Handbook of Chemistry and Physics,* R. C. Weast, CRC Press, Inc., 61st Ed., 1980.

Temperatures suitable for the instant invention are both sufficient to cause cracking of the heavy hydrocarbons and equal to or greater than the critical temperature of the solvent employed in the cracking medium. Suitable temperatures are typically greater than 300° C. but may be higher depending on the choice of solvent. Suitable pressures are at least 2000 psig. Typical operating conditions are temperatures between 300° C. and 500° C. and pressures of at least 2000 psig. Preferred operating conditions are temperatures between 375° C. and 450° C. and pressures of at least 4000 psig. The only practical upper limit on pressure for this process is the strength of the reaction vessel.

Yields of cracked liquid hydrocarbons, as a volume percent of heavy hydrocarbons originally introduced into the reactor, as high as 105 percent have been achieved. Yields greater than 100 percent result from the oligomerization of the olefins and the reaction of olefins with other fragments to form the liquid hydrocarbons, as well as a decrease in the density of the products. The yield is dependent upon several interrelated operational parameters. These parameters are temperature, pressure, residence time, the nature and concentrations of the olefins and the desired product.

The residence time is the amount of time the heavy hydrocarbons and olefins are in contact with the solvent containing medium at process conditions in order to produce liquid hydrocarbons. Optimum residence time is dependent upon the other operational parameters. Generally, for a specific temperature and pressure the degree of cracking and oligomerization increases with residence time. However the incremental improvement in the degree of cracking and oligomerization decreases for a residence time greater than one hour. Preferred residence times range from about one minute to six hours. More preferred residence times range from about three minutes to about three hours. Most preferred residence times range from about five minutes to about one hour.

The heavy hydrocarbon to light olefin weight ratio is between about 100:1 to about 1:1. Preferably this ratio is between about 80:1 to about 3:1 and more preferably between about 10:1 to about 5:1.

Typically, the solvent to heavy hydrocarbon weight ratios at least 0.25 to 1, with the only upper limit to this ratio being the size of the process equipment. However a preferred solvent to hydrocarbon weight ratio is about 1:1 to about 2:1.

The process of the instant invention may be done in batch or in a continuous flow reactor. In either case the reactor should be able to withstand several thousand pounds of pressure and be equipped with a means for mixing of the heavy hydrocarbon, olefin and solvent containing medium. In this process, the reactor is first purged with an inert gas, e.g. argon, nitrogen or steam, in order to yield the reactor substantially free of oxygen. Next, the heavy hydrocarbons and olefins and the solvent are fed into the reactor. These may be introduced in separate or combined feeds, and any single feed or all feeds may be subjected to preheating. The reactants are then mixed and heated to a temperature sufficient to cause cracking.

The product of both bulk and continuous flow reactors includes liquid hydrocarbons, carbon monoxide, carbon dioxide, unreacted olefins and gaseous alkanes. These products are separated by conventional techniques. Typically, any unreacted heavy hydrocarbons and olefins are recycled.

An advantage to heavy hydrocarbon cracking in a solvent containing medium is that only a small quantity of coke is produced inside the reactor. This is a major benefit. Coke tends to foul conventional reactors and where large quantities of coke are produced the reactors must be shut down regularly and cleaned. The small quantity of coke in this invention means that these reactors are capable of being operated continuously. Lastly, small quantities of coke allow for the easier separation of the reactor products.

A preferred embodiment of the instant invention is the cracking of heavy hydrocarbons in the presence of light olefins while in contact with a water containing medium. While not wishing to be bound by theory, it is believed that the water containing medium functions as a catalyst, a reactant and as a means to control the rate of reaction and rate of heat transfer from the system. As a catalyst, the water containing medium moderates both free radical and ionic mechanisms. As a reactant, supercritical water is a donor of hydrogen for saturating double bonds. This is evidenced by the resulting liquid hydrocarbons being largely paraffinic and the existence of carbon monoxide and carbon dioxide in the gaseous effluent from the reactor. Since water is a donor of hydrogen, no externally supplied hydrogen is required for the instant process.

The cracking of heavy hydrocarbons is a highly endothermic reaction. In contrast, the oligomerization of olefins is a highly exothermic reaction. The water containing medium can be used to control the rate of these reactions and keep the system isothermal by adjustments in the water to hydrocarbon ratio.

SPECIFIC EMBODIMENTS

The following Examples are provided in order to better illustrate the instant invention. In each of the Examples the reactor product was analyzed using a gas chromatograph in order to determine product composition and relative quantities of each component.

Example A

Water and shale oil were loaded into a 300 cc stainless steel stirred autoclave, to give a water-to-oil weight ratio of about 2. The unit was heated at 425° C. for sixty minutes at an average pressure of 4750 psig. The following product distribution was obtained: 75 weight percent distillate, 5 weight percent gas, 2 weight percent coke based on the initial weight of the shale oil feedstock.

This example does not practice the above-mentioned invention. It is offered to illustrate the cracking of shale oil in supercritical water.

Example 1

Water and shale oil were loaded into a 300 cc stainless steel stirred autoclave, to give a water-to-oil weight ratio of about 2. Ethylene gas was then added to give a gas-to-oil weight ratio of between 0.1 and 0.2. The unit was heated at 425° C. for sixty minutes at an average pressure of 4901 psig. The following product distribution was obtained: 83 volume percent distillate, 0 weight percent gas, 2 weight percent coke based on the initial weight of the shale oil feedstock.

This example illustrates the beneficial effect to cracking in the presence of ethylene.

Example 2

The procedure of Example 1 was repeated except that propylene was used in place of the ethylene. The following product distribution was obtained: 81 volume percent distillate, 0 weight percent gas, and 3 weight percent coke based on the initial weight of the shale oil feedstock.

Example B

Shale oil and ethylene were loaded into a 300 cc stainless steel stirred autoclave to give a gas-to-oil ratio of 0.27. No water was added. The unit was heated to 425° C. for sixty minutes at an average pressure of 990 psig. The following product distribution was obtained: 71 volume percent distillate, 10 weight percent gas, 31 weight percent coke based on the initial weight of the shale oil feedstock.

This example does not practice the above-mentioned invention. Rather, it demonstrates the detrimental results of operating without supercritical water. Note that while the gas make was reduced, a large amount of low value coke results.

Example C

Shale oil and water were loaded into a 300 cc stainless steel stirred autoclave to give a water-to-oil weight ratio of about 2. Ethane gas was added to give a gas-to-oil ratio of 0.16. The unit was heated at 422° C. for sixty minutes at an average pressure of 5637 psig. The following product distribution was obtained: 66 volume percent distillate, 11 weight percent gas, 3 weight percent coke based on the initial weight of the shale oil feedstock.

This example does not practice the above-mentioned invention. Rather, it demonstrates the detrimental effects of operating with an added paraffinic gas stream, instead of the specific olefinic gas stream.

Example D

The procedure of Example A was repeated using hexadecane in the place of shale oil. The following product distribution was obtained: 25 volume percent cracked liquid, 2 weight percent gas and 2 weight percent coke.

Example 3

The procedure of Example 1 was repeated using hexadecane in the place of shale oil. The following product distribution was obtained: 46 volume percent cracked liquid, 0 weight percent gas and 3 weight percent coke.

Although only a few embodiments of this invention have been described above, it should be appreciated that many additions and modifications can be made without departing from the spirit and scope of the invention. These and all other modifications are intended to be included within the scope of this invention, which is to be limited only by the following claims.

The invention claimed is:

1. A process for upgrading and cracking heavy hydrocarbons comprising adding to the heavy hydrocarbons olefins containing five or less carbon atoms and a water-containing solvent to form a mixture and subjecting the mixture to a temperature and pressure which is equal to or greater than the critical temperature and pressure of the water-containing solvent.

2. The process of claim 1 where the heavy hydrocarbons have an I.B.P. of 200° C. and greater.

3. The process of claim 2 where the heavy hydrocarbons are selected from the group consisting of tar, bitumin, shale oil, kerogen and coal liquids.

4. The process of claim 1 where the olefins are selected from the group consisting of ethylene, propylene, butylene, butadiene, pentene and isomers and substituted derivatives thereof.

5. The process of claim 4 where the olefins are selected from the group consisting of ethylene and propylene.

6. The process of claim 1 where the temperature is between about 300° C. and about 500° C. and the pressure is greater than about 2000 psig.

7. The process of claim 6 where the temperature is between about 375° C. and about 450° C. and the pressure is greater than or equal to about 4000 psig.

8. The process of claim 1 where the contact time for the heavy hydrocarbons with the olefins and water-containing solvent is between about 1 minute and about 6 hours.

9. The process of claim 8 where the contact time for the heavy hydrocarbons with the olefins and water-containing solvent is between about 3 minutes and about 3 hours.

10. The process of claim 9 where the contact time for the heavy hydrocarbons with the olefins and water-containing solvent is between about 5 minutes and about 1 hour.

11. The process of claim 1 where the weight ratio of heavy hydrocarbons to light olefins is between about 100:1 and about 1:1.

12. The process of claim 11 where the weight ratio of heavy hydrocarbons to light olefins is between about 80:1 to about 3:1.

13. The process of claim 12 where the weight ratio of heavy hydrocarbons to light olefins is between about 10:1 and about 5:1.

14. The process of claim 1 where the weight ratio of water-containing solvent to heavy hydrocarbons is greater than or equal to about 0.25:1.

15. The process of claim 14 where the weight ratio of water-containing solvent to heavy hydrocarbons is between about 1:1 to about 2:1.

16. The process of claim 1 where the process is conducted in a batch or a continuous flow reactor.

17. The process of claim 1 where the water-containing solvent contains a member selected from the group consisting of carbon dioxide, ammonia, water, alcohols, benzene, toluene, dichlorodiflouromethane, nitrous oxide, diethyl ether, sulfur dioxide, carbon disulfide, tetrahydrofuran, acetone, pyridine, methyl chloride and mixtures thereof.

18. The process of claim 17 where the water-containing solvent contains an alcohol.

19. In a process for upgrading and cracking heavy hydrocarbons where the heavy hydrocarbons are contacted with a cracking medium at the critical temperature and pressure of the medium, the improvement comprising adding to the medium olefins containing five or less carbon atoms prior to upgrading and cracking the heavy hydrocarbons.

* * * * *